United States Patent [19]

Ebert et al.

[11] 4,251,682

[45] Feb. 17, 1981

[54] OPERATION OF A LEAD-IN-DEVICE RECEIVING A CONDUCTOR PASSED THROUGH THE COVER OF AN ELECTRICAL PRECIPITATION APPARATUS

[75] Inventors: Hans Ebert, Erftstadt; Hans Kerber, Hürth-Knapsack; Robert Queck, Hürth-Burbach, all of Fed. Rep. of Germany

[73] Assignee: Hoechst Aktiengesellschaft, Fed. Rep. of Germany

[21] Appl. No.: 134,775

[22] Filed: Mar. 28, 1980

[30] Foreign Application Priority Data

Apr. 2, 1979 [DE] Fed. Rep. of Germany ..... 2913104

[51] Int. Cl.[3] ..... B03C 3/66; H01B 17/26

[52] U.S. Cl. ..... 174/31.5; 55/120; 55/146; 174/17 GF

[58] Field of Search ..... 174/14 BH, 17 GF, 17.06, 174/18, 31 R, 31.5; 55/117, 120, 146, 355

[56] References Cited

U.S. PATENT DOCUMENTS

| | | | |
|---|---|---|---|
| 1,528,296 | 3/1925 | Harris | 174/17 GF X |
| 3,004,833 | 10/1961 | Loewen | 55/146 X |
| 3,595,983 | 7/1971 | Muller et al. | 174/31.5 |
| 3,627,898 | 12/1971 | Ibach et al. | 174/31.5 X |
| 3,755,611 | 8/1973 | Queck et al. | 174/31.5 X |
| 3,773,966 | 11/1973 | Ebert et al. | 174/31.5 |

FOREIGN PATENT DOCUMENTS 443227 1/1968 Switzerland .

*Primary Examiner*—Laramie E. Askin
*Attorney, Agent, or Firm*—Connolly and Hutz

[57] ABSTRACT

The invention relates to a process for operating a lead-in-device receiving a conductor which passes through the cover of an electrical precipitation apparatus down to its electrode system. A portion of the conductor is encircled by an insulator which is radially spaced therefrom and of which the upper end provides support for a structural component having the conductor gas tightly passed therethrough. The space inside the insulator receives a sealing gas which is maintained under a pressure higher than that prevailing in the electrical precipitation apparatus. The sealing gas used for operating the device is a gas mixture consisting of an inert gas and at least 10 volume % of methane.

7 Claims, 1 Drawing Figure

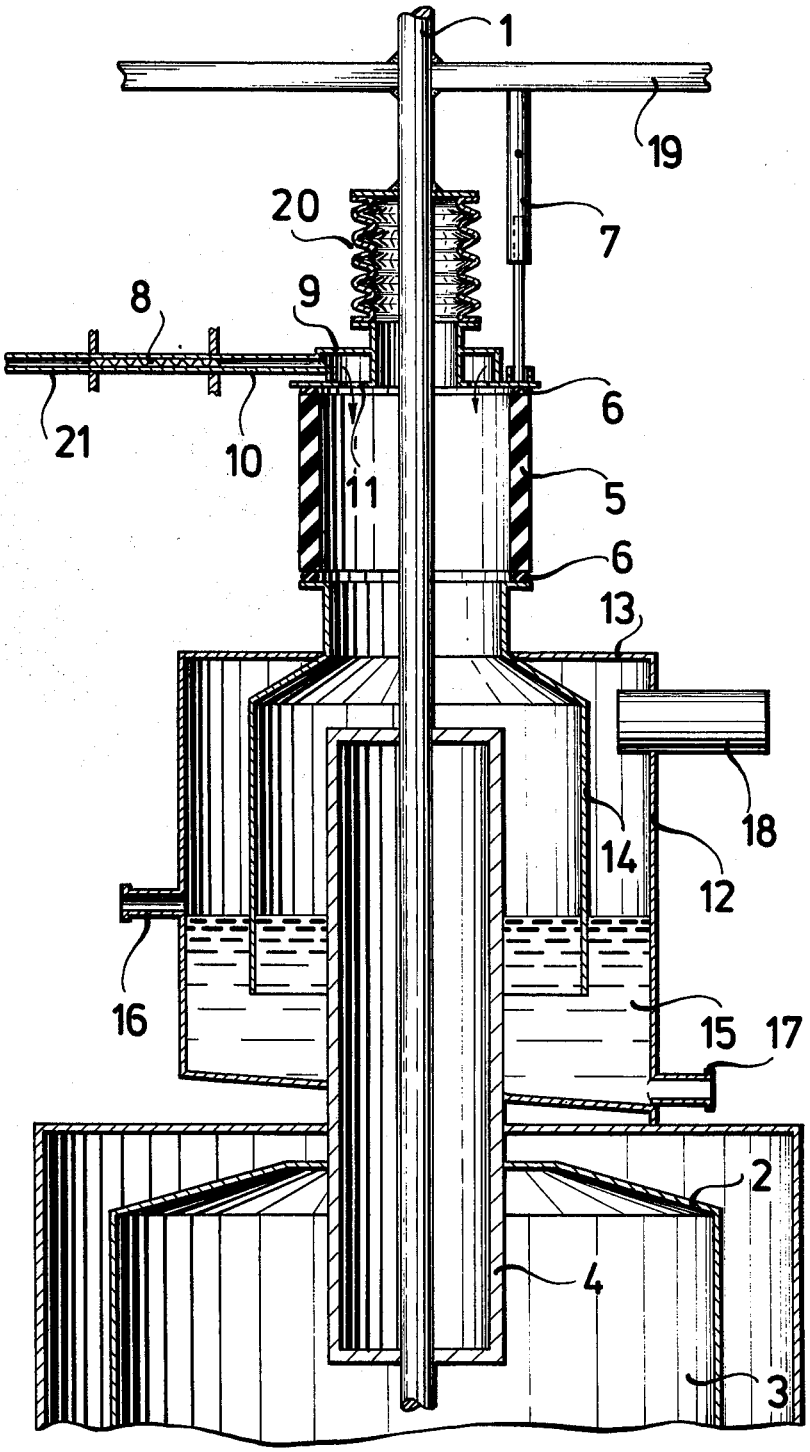
1
19
20
7
8
9
6
21
10
11
5
6
13
18
14
12
16
15
17
2
4
3

OPERATION OF A LEAD-IN-DEVICE RECEIVING A CONDUCTOR PASSED THROUGH THE COVER OF AN ELECTRICAL PRECIPITATION APPARATUS

The present invention relates to a process for operating a lead-in-device receiving a conductor which passes through the cover of an electrical precipitation apparatus down to its electrode system, a portion of the conductor being encircled by a cylindrical insulator which is radially spaced therefrom and of which the upper end provides support for a structural component having the conductor gastightly passed therethrough, the space inside the insulator receiving a sealing gas which is maintained under a pressure higher than that prevailing in the electrical precipitation apparatus.

A lead-in-device which is operated with the use of a hydrogen/carbon monoxide-mixture as the sealing gas has been described in Swiss Pat. No. 443,227.

Further devices of this kind which are suitable for use in the production of phosphorus and wherein nitrogen is used as the sealing gas have been described in German Pat. No. 1,801,143 (corresponding U.S. Pat. No. 3,595,983) and German "Offenlegungsschrift" No. 2,139,824 (corresponding U.S. Pat. No. 3,755,611). Nitrogen, however, is readily ionizable gas and therefore liable to effect electrical discharges of which the arcs are liable to impair insulating structural parts (made up of polytetrafluoroethylene) and the efficiency of the electrical precipitation apparatus.

A still further lead-in-device which is suitable for use in the production of phosphorus and wherein the sealing gas is superheated steam of 120° to 200° C. has been described in German Pat. No. 2,209,999 (corresponding U.S. Pat. No. 3,773,966). This apparatus is shown diagrammatically in the accompanying drawing.

With reference thereto:

A conductor 1 is arranged to project through a cover 2 down to the electrical system of an electrical precipitation apparatus 3. The conductor 1 is concentrically surrounded by a duct 4 projecting, from a level above the cover 2, into the interior of the electrical precipitation apparatus 3. Above the duct 4, the conductor 1 is surrounded by a cylindrical insulator 5, which is radially spaced therefrom and of which the lower end is sealed by an elastic packing 6 which is supported by an upper flange provided on a bell-shaped member 14 forming an inner part of a sealing cup 12. At the upper end of the insulator 5, which is also sealed by an elastic packing 6, is an annular chamber 9 of which the lower surface is apertured to provide outlets 11. The annular chamber 9 is urged towards the insulator 5 by spring-pressed rods 7 mounted in sleeves which bear against cross-members 19 fast with the conductor 1. The annular chamber 9 is further provided with a pipe connection 10 opening laterally thereinto. The pipe connection 10 and an insulating joint 8 connect the chamber 9 to a conduit 21 supplying a sealing gas. Disposed above the annular chamber 9 is a bellows 20 which is secured at its lower end to a flange provided on the chamber 9 and is secured at its upper end to the conductor 1.

The bell-shaped member 14 is arranged so as to open out into the sealing cup 12, its upper end passing through the cover 13 of the sealing cup 12. The lower portion of the sealing cup 12 is filled with water 15, which is supplied thereto through an inlet 17 and removed therefrom through an outlet 16. The upper portion of the sealing cup 12 has an off-gas connection 18 running to a chimney.

Although superheated steam shows a satisfactory ionization behaviour, its use in the apparatus described in German Pat. No. 2,209,999 (corresponding U.S. Pat. No. 3,773,966) is not fully satisfactory inasmuch as large surface portions of the electrical precipitation apparatus, the electrode system and conductor are liable to undergo corrosion and in fact material is removed therefrom, the corrosion occurring at a rate of 2 to 5 mm per year. The corrosion is obviously caused by acids of phosphorus which are being formed by reaction between the steam and phosphorus in vapor form, which is passed through the electrical precipitation apparatus at about 350° C. The acids of phosphorus are also liable to form, together with dusty material, solid glutinous material depositing inside the electrical precipitation apparatus. This is glutinous material which is difficult to remove and impairs the efficiency of the electrical precipitation apparatus. The fact that additional heat is introduced into the system by the superheated steam has adverse effects on the cold condensation stage which is arranged downstream of the electrical precipitation apparatus, and of which the temperature is increased by 10° to 15° C. As a result, the $P_2O_5$-emission of the entire apparatus is undesirably increased and the phosphorus yield reduced.

It is therefore an object of the present invention to provide a process for operating a lead-in-device receiving a conductor which passes through the cover of an electrical precipitation apparatus down to its electrode system, the electrical precipitation apparatus being preferably used in the production of phosphorus.

If operated in accordance with this invention, the electrical precipitation apparatus and accessory equipment are not liable to undergo corrosion, nor are insulating structural components impaired by exposure to electrical arcs. In addition to this, use is made in the present process of sealing gas which does not introduce additional heat into the gas mixture passed through the electrical precipitation apparatus.

To this end, the invention provides for the sealing gas to comprise a gas mixture consisting of an inert gas and at least 10 volume% of methane.

Preferred features of the present process provide:

(a) for the gas mixture to contain up to 90 volume% of methane;

(b) for the gas mixture to contain up to 33 volume% of methane;

(c) for the inert gas to comprise nitrogen;

(d) for the inert gas to comprise a nitrogen/carbon dioxide-mixture;

(e) for the inert gas to comprise a mixture obtained by subjecting natural gas to combustion with air in the stoichiometric hydrocarbon to oxygen ratio; and (f) for the sealing gas to be made by mixing the inert gas with natural gas.

The electrical precipitation apparatus and its accessory equipment which are operated by the process of this invention undergo surface corrosion, independently of the particular gas mixture which is passed therethrough, at the low rate of only about 0.1 mm per year, which is acceptable from a commercial point of view.

Material depositing inside the electrical precipitation apparatus always is dry dust, which is easy to remove.

Use is made in the present process of sealing gas which is ionizable to a small extent only so that electrical discharges are not liable to occur within the region of insulating structural components.

In the present process used for operation of an apparatus of the kind described hereinbove, of which the electrical precipitation apparatus has reaction gas coming from a phosphorus furnace passed therethrough, the heating value of the methane forming part of the sealing gas is not lost inasmuch as the latter is mixed, inside the electrical precipitation apparatus, with reaction gas consisting essentially of phosphorus in vapor form and carbon monoxide. The resulting mixture can be scrubbed with water to be freed from phosphorus, the remaining mixture consisting of carbon monoxide, methane and inert gas being suitable for use as a heating gas.

We claim:

1. A process for operating a lead-in-device receiving a conductor which passes through the cover of an electrical precipitation apparatus down to its electrode system, a portion of the conductor being encircled by an insulator which is radially spaced therefrom and of which the upper end provides support for a structural component having the conductor gastightly passed therethrough, the space inside the insulator receiving a sealing gas which is maintained under a pressure higher than that prevailing in the electrical precipitation apparatus, which comprises: using, as the sealing gas, a gas-mixture consisting of an inert gas and at least 10 volume% of methane.

2. The process as claimed in claim 1, wherein the gas mixture contains up to 90 volume% of methane.

3. The process as claimed in claim 1, wherein the gas mixture contains up to 33 volume% of methane.

4. The process as claimed in claim 1, wherein the inert gas is nitrogen.

5. The process as claimed in claim 1, wherein the inert gas is a mixture of nitrogen and carbon dioxide.

6. The process as claimed in claim 1, wherein the inert gas is a mixture obtained on subjecting natural gas to combustion with air in the stoichiometric hydrocarbon to oxygen ratio.

7. The process as claimed in claim 1, wherein the sealing gas is made by mixing the inert gas with natural gas.

* * * * *